US007341656B1

(12) United States Patent
Malone et al.

(10) Patent No.: US 7,341,656 B1
(45) **Date of Patent: *Mar. 11, 2008**

(54) CONTINUOUS OXIDATION AND DISTILLATION PROCESS OF HEAVIER HYDROCARBON MATERIALS

(75) Inventors: Donald P. Malone, Grayson, KY (US); Patricia K. Doolin, Ashland, KY (US); Howard F. Moore, Ashland, KY (US)

(73) Assignee: Marathon Ashland Petroleum Co. LLC, Findlay, OH (US)

( * ) Notice: Subject to any disclaimer, the term of this patent is extended or adjusted under 35 U.S.C. 154(b) by 654 days.

This patent is subject to a terminal disclaimer.

(21) Appl. No.: 10/898,836

(22) Filed: Jul. 26, 2004

(51) Int. Cl.

| | |
|---|---|
| ***C10G 27/04*** | (2006.01) |
| ***C10G 27/00*** | (2006.01) |
| ***C10C 1/00*** | (2006.01) |
| ***C10C 1/04*** | (2006.01) |
| ***C10C 3/00*** | (2006.01) |
| ***C10C 3/04*** | (2006.01) |
| ***C10C 3/06*** | (2006.01) |

(52) U.S. Cl. ..... 208/4; 208/6; 208/39; 208/41; 208/42; 208/43

(58) Field of Classification Search ..... 106/502; 208/4, 22, 39, 6, 41, 42, 43
See application file for complete search history.

(56) References Cited

U.S. PATENT DOCUMENTS

| | | | | |
|---|---|---|---|---|
| 6,068,759 | A | 5/2000 | Moore et al. | |
| 6,110,239 | A | 8/2000 | Malone et al. | |
| 6,270,657 | B1 * | 8/2001 | Moore et al. | 208/39 |
| 6,402,937 | B1 | 6/2002 | Shaffer, Jr. et al. | |
| 6,402,938 | B1 * | 6/2002 | Moore et al. | 208/179 |
| 6,447,672 | B1 | 9/2002 | Moore et al. | |
| 7,220,348 | B1 * | 5/2007 | Malone et al. | 208/39 |

* cited by examiner

*Primary Examiner*—Glenn Caldarola
*Assistant Examiner*—Randy Boyer
(74) *Attorney, Agent, or Firm*—Emch, Schaffer, Schaub & Porcello Co., L.P.A.

(57) ABSTRACT

The present invention provides a way to process heavier hydrocarbons in a relatively low cost and low pressure process using a combination of superheated steam and at least one reaction gas to i) promote oxidation and thermal reaction of heavier hydrocarbons, while simultaneously ii) removing volatile components with a steam stripping process.

12 Claims, 2 Drawing Sheets

CONTINUOUS OXIDATION AND DISTILLATION PROCESS OF HEAVIER HYDROCARBON MATERIALS

CROSS REFERENCE TO RELATED APPLICATIONS

This invention is an improvement of the basic Used Motor Oil (UMO) processes described in U.S. Pat. Nos. 6,068,759; 6,270,657; 6,402,937; 6,402,938; and 6,447,672; which are incorporated herein by reference. These prior patents and the instant invention have overlapping inventors and a common assignee.

FIELD OF THE INVENTION

This invention relates to a process for removing volatile components from heavier hydrocarbons. In particular, the invention relates to a continuous processing system to promote the oxidation and the thermal reaction of heavier hydrocarbons and includes a steam stripping process to remove volatile components. For example, the present invention is useful to treat FCC/RCC slurry oil, asphalt, petroleum pitch and the like.

BACKGROUND OF THE INVENTION

Heavier hydrocarbon materials include FCC/RCC slurry oil, asphalt, petroleum pitch and the like.

Heavier hydrocarbon materials also include automotive lubricating oils which are usually formulated from paraffin based petroleum distillate oils or from synthetic base lubricating oils. Lubricating oils are combined with additives such as soaps, extreme pressure (E.P.) agents, viscosity index (V.I.) improvers, antifoamants, rust inhibitors, anti-wear agents, antioxidants, and polymeric dispersants to produce an engine lubricating oil of SAE 5 to SAE 60 viscosity.

After use, this oil is collected from truck and bus fleets, automobile service stations, and municipal recycling centers for reclaiming. This collected oil contains organo-metallic additives such as zinc dialkylthiophosphate from the original lubricating oil formulation, sludge formed in the engine, and water. The used oil may also contain contaminants such as waste grease, brake fluid, transmission oil, transformer oil, railroad lubricant, crude oil, antifreeze, dry cleaning fluid, degreasing solvents such as trichloroethylene, edible fats and oils, mineral acids, soot, earth and waste of unknown origin.

Reclaiming of waste oil is largely carried out by small processors using various processes tailored to the available waste oil, product demands, and local environmental considerations. Such processes at a minimum include chemical demetallizing or distillation. The presence of organo-metallics in waste oils such as zinc dialkylthiophosphate results in waste oils becoming sticky, overly viscous and thus difficult, if not impossible, to process. Moreover, the resulting sludge created reduces the amount of salable product, as well as creating additional disposal problems.

Successful reclaiming processes require the reduction of the organo-metallics (or ash) content to a level at which the hot oil does not become sticky. Such reduction can be carried out by chemical processes which include reacting cation phosphate or cation sulfate with the chemically bonded metal to form metallic phosphate or metallic sulfate. U.S. Pat. No. 4,432,865 to Norman, the contents of which are incorporated herein by reference, discloses contacting used motor oil with polyfunctional mineral acid and polyhydroxy compound to react with undesired contaminants to form easily removable reaction products. These chemical processes suffer from attendant disposal problems depending on the metal by-products formed.

Ash content can also be reduced by heating the used lubricating oil to decompose the organo-metallic additives. However, indirect heat exchange surfaces cannot be maintained above 400° F. (204° C.) for extended periods without extensive fouling and deposition of metals from the additives. Used lubricating oils can be heated to an additive decomposition temperature of 400° F. (204° C.) to 1000° F. (538° C.) by direct heat exchange by mixing with a heated product oil as disclosed in U.S. Pat. No. 5,447,628 to Harrison, et al., the contents of which are incorporated herein by reference. However, dilution of the product oil with used oil obviously suffers from the inefficiency of reprocessing already processed product oil, as well as rapid fouling of reactor surfaces. U.S. Pat. No. 4,101,414 to Kim, et al., incorporated herein by reference, discloses predistillation by steam stripping for several hours of a used lubricating oil stock in order to remove light oil, residual water, sulfur, and $NO_x$. The temperature is kept at temperatures which avoid additive breakdown, and the process provides a concentrate product upon vacuum distillation. Flow processes using heat exchange by direct contact with hot hydrogen have been proposed but are expensive in view of the costs associated with hydrogen compression and hydrogen's low heat capacity. Such processes include UOP's Hy-Lube described in U.S. Pat. Nos. 5,244,565 and 5,302,282 which feature an initial used oil feed fractionation step to remove sludge and a majority of metals utilizing a hot circulating hydrogen stream as a heating medium to avoid deposition of decomposed organo-metallic compounds on heating surfaces, followed by a hydrotreating circuit with caustic neutralization to eliminate chlorides, with a final product fractionation step. Flow processes utilizing steam have also been proposed. However, even when used motor oil is directly heated, i.e., in the absence of heat transfer surfaces, the nozzles and downstream piping can plug in 24 to 72 hours due to the presence of organo-metallic compounds.

In particular, extensive work has been reported in the patent literature on use of large amounts of hot, high pressure hydrogen for vaporization of used motor oil (UMO). While such processes are certainly technically feasible, there are significant capital costs associated with the relatively high pressure operation reported (typically 500 psig). Operation at high pressure makes it difficult to vaporize the used lube oil components, so higher hydrogen addition/circulation rates are used to facilitate vaporization, with hydrogen circulation rates of 10,000-18,000 SCFB being reported. Hydrogen helps suppress some condensation coking reactions that otherwise could occur in the heating and vaporization step. The hydrogen is also present in an amount sufficient to supply the hydrogen demand of a downstream hydrotreating reactor. This combination, high-pressure hydrogen coupled with downstream hydrotreating, can produce a liquid product from a UMO fraction which is excellent for use as either a lube stock or as cracker charge.

Representative hot hydrogen UMO processes include:

U.S. Pat. No. 4,806,233, James, Jr., et al., Method Of Separating a Hot Hydrocarbonaceous Stream U.S. Pat. No. 4,818,368, Kalnes, et al., Process for Treating a Temperature-Sensitive Hydrocarbonaceous Stream Containing a Non-Component to Produce a Hydrogenated Distillable Hydrocarbonaceous Product U.S. Pat. No. 4,840,721, Kalnes, et al., Process for Treating a Temperature-Sensitive Hydrocarbonaceous Stream Containing a Non-Distillable Component to Produce a Hydrogenated Distillable Hydrocarbonaceous Product U.S. Pat. No. 4,882,037, Kalnes, et al., Process for Treating a Temperature-Sensitive Hydrocarbonaceous Stream Containing a Non-Distillable Component to Produce a Selected Hydrogenated Distillable Light Hydrocarbonaceous Product U.S. Pat. No. 4,923,590, Kalnes, et al., Process for Treating a Temperature-Sensitive Hydrocarbonaceous Stream Containing a Non-Distillable Component to Produce a Hydrogenated Distillable Hydrocarbonaceous Product U.S. Pat. No. 4,927,520, Kalnes, et al., Process for Treating a Hydrocarbonaceous Stream Containing a Non-Distillable Component to Produce a Hydrogenated Distillable Hydrocarbonaceous Product U.S. Pat. No. 5,004,533, Kalnes, et al., Process for Treating an Organic Stream Containing a Non-Distillable Component to Produce an Organic Vapor and a Solid U.S. Pat. No. 5,013,424, James, Jr., et al., Process for the Simultaneous Hydrogenation of a First Feedstock Comprising Hydrocarbonaceous Compounds and Having a Non-Distillable Component and a Second Feedstock Comprising Halogenated Organic Compounds U.S. Pat. No. 5,028,313, Kalnes, et al., Process for Treating a Temperature-Sensitive Hydrocarbonaceous Stream Containing a Non-Distillable Component to Produce a Distillable Hydrocarbonaceous Product U.S. Pat. No. 5,068,484, James, Jr., et al., Process for the Hydroconversion of a Feedstock Comprising Organic Compounds Having a Tendency to Readily Form Polymer Compounds U.S. Pat. No. 5,102,531, Kalnes, et al., Process for Treating a Temperature Sensitive Hydrocarbonaceous Stream Containing a Non-Distillable Component to Produce a Distillable Hydrocarbonaceous Product U.S. Pat. No. 5,176,816, Lankton, et al., Process to Produce a Hydrogenated Distillable Hydrocarbonaceous Product U.S. Pat. No. 5,244,565, Lankton, et al., Integrated Process for the Production of Distillate Hydrocarbon U.S. Pat. No. 5,302,282, Kalnes, et al., Integrated Process for the Production of High Quality Lube Oil Blending Stock U.S. Pat. No. 5,316,663, James, Jr., Process for the Treatment of Halogenated Hydrocarbons U.S. Pat. No. 5,354,931, Jan, et al., Process for Hydrotreating an Organic Feedstock Containing Oxygen Compounds and a Halogen Component U.S. Pat. No. 5,384,037, Kalnes, Integrated Process for the Production of Distillate Hydrocarbon U.S. Pat. No. 5,401,894, Brasier, et al., Process for the Treatment of Halogenated Organic Feedstocks U.S. Pat. No. 5,552,037, Kalnes, et al., Process for the Treatment of Two. Halogenated Hydrocarbon Streams U.S. Pat. No. 5,723,706, Brasier, et al., Process for the Treatment of Halogenated Organic Feedstocks U.S. Pat. No. 5,817,288, Bauer, et al., Process for Treating a Non-Distillable Halogenated Organic Feed Stream U.S. Pat. No. 5,904,838, Kalnes, et al., Process for the Simultaneous Conversion of Waste Lubricating Oil and Pyrolysis Oil, Derived from Organic Waste to Produce a Synthetic Crude Oil While this approach is excellent in terms of product quality, the capital and operating expense of such an approach are significant.

The present invention is an improvement over the commonly owned U.S. Pat. Nos. 6,068,759 and 6,270,657 which disclose a process for recovering lube oil base stocks from used lubricating oil formulations containing base oil stock and organo-metallic component by directly contacting used lubricating oil with a heated vapor, e.g., steam, under conditions which at least partially decompose the organo-metallic component and provide a desired volume of pumpable bottoms containing organo-metallic compound decomposition products and an overhead comprising gases and distillable hydrocarbons, with no substantial carryover of metals into the overhead.

The present invention is also an improvement over the commonly owned U.S. Pat. No. 6,402,937 which discloses a process for thermally processing/vaporizing UMO by direct injection of superheated vapor into a UMO vaporization vessel.

Further, while there has been extensive use of high pressure hydrogen for vaporization and subsequent hydrotreating of UMO, such a process has never included the use of a combination of superheated steam and a reaction gas to i) promote oxidation and thermal reaction of heavier hydrocarbons, while simultaneously ii) removing volatile components with a steam stripping process.

The present invention is also an improvement over the commonly owned U.S. Pat. No. 6,402,938 which discloses a process for recovering. UMOs by heating a compressed recycled vapor to produce a superheated vapor; such process requires compression of the vapor without hydrogenation of the UMO.

Until the present invention there has not been a process that could be used to promote oxidation and thermally process/vaporize heavier hydrocarbons by direct injection of a combination of superheated steam and reaction gases.

It would be advantageous to provide an efficient method for oxidizing and thermally reacting heavier hydrocarbons in a process which upgrades and/or recovers large quantities of hydrocarbon materials in a continuous manner.

It would also be advantageous to provide an efficient method for oxidizing and thermally reacting heavier hydrocarbons in a process which does not require apparatus susceptible to clogging or fouling under the conditions encountered during decomposition of metallic additives. It would also be advantageous to provide a process for treating heavier hydrocarbon material which does not require pre-separation of lighter and/or volatile materials or water typically found in the heavier hydrocarbon materials as collected.

SUMMARY OF THE INVENTION

The present invention provides a way to process heavier hydrocarbons in a relatively low cost and low pressure facility using direct injection of superheated steam and reaction gases to oxidize and thermally process the heavier hydrocarbons. The process of the present invention allows processors, by selection of desired superheated steam and reaction gases and process conditions, to oxidize and thermally react much or all of the injected heavier hydrocarbon materials into useful end products of both liquid hydrocarbon product and lighter volatile hydrocarbon product.

According to one embodiment, the present invention includes the use of at least one atomizer nozzle which combines at least one or more streams of the steam and reaction gases with a supply stream of the heavier hydrocarbons, and atomizes both streams such that the oxidation and the thermal reaction occur in an optimum manner.

In one aspect, the present invention relates to a process for promoting an oxidation and thermal reaction of hydrocarbon materials and for removing volatile components and includes the steps of:

i) directly contacting at least one stream of the hydrocarbon materials with a heated stream comprising steam and at least one reaction gas selected from the group comprising oxygen, air or hydrogen, under temperature, contact times, and superficial velocity conditions sufficient to at least partially oxidize the hydrocarbon materials and to provide a desired volume of at least partially oxidized liquid product in at least one suitable disengaging vessel, and a remaining volume of volatile overhead product and steam;

ii) condensing the volatile overhead product in at least one stage;

iii) recovering at least part of the volatile overhead product as distillate;

iv) condensing the steam in a second stage, and v) recovering a bottoms fraction containing the at least partially oxidized liquid products.

In certain embodiments, the hydrocarbon material is preheated prior to directly contacting the at least one stream of the hydrocarbon materials with the heated stream comprising steam and the at least one reaction gas. Further, it is within the contemplated scope of the present invention that the hydrocarbon material can be at partially fractionated or flashed to remove a majority, by weight, of at least one of chemical solvents boiling in the gasoline boiling range and gasoline boiling range components prior to being contacted by the steam and the at least one reaction gas.

In certain preferred embodiments when heavier hydrocarbons such as UMOs are being treated there are no substantial carryovers of metals into the volatile overhead product which means that the overhead product contains no greater than 100 ppm, preferably no greater than 50 ppm metals content. In contrast, the heavier hydrocarbon material feed can contain from 3000 to 5000 ppm metals. Metals content includes all metals present including organo-metallic compounds, partially decomposed organo-metallic compounds, and completely decomposed organo-metallic compounds.

In certain aspects, the contacting can be carried out as a continuous process where the contacting of the heavier hydrocarbon material with the heated stream of steam and reaction gas occurs in a flow mixing means, e.g., a nozzle.

In other embodiments, the present invention can be carried out as a batch process using a plurality of vessels.

By the term "stream" is meant a mixture of the water vapor steam and at least one reaction gas material in gaseous form that is introduced into the present process. As such, this includes those materials which can be in a non-gaseous form at room temperature, e.g., $H_2O$ (steam). The reaction gases employed in the present invention include air, oxygen and hydrogen.

The heated stream of steam and reaction gas or gases is introduced through an atomizing nozzle at temperatures ranging from about 450 to about 1800° F., preferably from about 700 to about 1100° F., at a vapor rate of about 0.1 to about 10 pounds/pound of charge, preferably about 2 to about 3 pounds/pound of charge and a superficial velocity of no greater than about 5.5 feet per second, preferably no greater than about 3 feet per second. The preferable velocities are such that the heavier hydrocarbon material are "atomized" into sufficiently small particles to readily react with the reaction gas and yet low enough to prevent entrainment of undesired materials, such as organo-metallic compounds, in the volatile overhead product. In certain embodiments such velocity is generally no greater than about 5.5 feet per second, preferably no greater than about 3 feet per second. Vaporization temperatures achieved in the nozzle can range from 400 to 1000° F., preferably 550 to 650° F. The heavier hydrocarbon material is contacted with the heated stream for a period ranging from about 0.1 to about 2 seconds, e.g., 1 second, preferably from about 0.25 to 0.5 seconds. The vaporization temperatures, steam rates, superficial velocities and contact times are adjusted to provide a preset volume reduction of the total amount of heavier hydrocarbon that has been introduced into the nozzle (or degree of lift of overhead vapors), e.g., ranging from about 20 to about 95 wt. %, preferably from about 60 to about 90 wt. % of the total amount of heavier hydrocarbon material introduced into the nozzle.

In one embodiment of the present invention, the volatile overhead product is condensed at a temperature above the condensing temperature of steam. The heated steam is then condensed in a second stage. The reaction gases are consumed in the oxidation process to oxidize the heavier hydrocarbon material.

The above conditions may be varied to adjust the extent of decomposition and/or oxidation of the hydrocarbon components in the heavier hydrocarbon materials. In certain embodiments where used lubricating oils are processed by the present invention, the used oils may contain organo-metallic compounds in a concentration of about 0.01 to about 5.0 wt. %. The treatment of the present invention decomposes the organo-metallic component to an extent sufficient to provide a product having an organo-metallic component concentration of about 0.005 wt. % or less, preferably less than about 0.001 wt. %.

In an especially preferred embodiment, the heated steam is superheated steam. The fouling of used motor oil-contacted surfaces ordinarily observed during UMO processing does not occur in this embodiment. The use of steam may lower partial pressure of the vaporization of the overhead so that vaporization temperatures no greater than 650° F. or even 600° F. can be used. Such lower vaporization temperatures combined with lower contact times may be particularly desirable inasmuch as they may minimize the decomposition of valuable additives of the used lubricating oils, such as viscosity index improvers, pour point depressants, defoamants, and detergent-dispersants, which can be present in used lubricating oils in amounts of at least about 0.1 wt. %, e.g., ranging from about 0.1 to about 25 wt. %, preferably about 1 to about 10 wt. %.

The presence of these high molecular weight polymer additives in the pumpable bottoms fraction can be especially advantageous when the bottoms, are added to such products as performance graded asphalts. Alternatively, the pumpable bottoms can be combined with fuel oil; however, the additives thus introduced confer less benefit than in asphalt.

In another preferred embodiment of the invention, the used lubricating, oils contain at least about 0.1 wt. %, preferably at least about 1 wt. % of viscosity index improver, and said vaporization temperatures and contact times are such as to minimize decomposition of said viscosity index improver so as to provide a bottoms fraction containing organo-metallic compound decomposition products and at least about 0.1 wt. %, preferably at least about 1 wt. %, viscosity index improver.

In another aspect, the invention relates to a novel asphalt blend composition containing, an asphalt component and the used motor oil bottoms product prepared by the process of the present invention, with or without modification additives such as polymers, chemical gellants and antioxidants, and to paving compositions containing such modified asphalts.

Generally, the asphalt blend compositions comprise (a) about 0.1 to about 20 wt. %, preferably about 0.5 wt. % to about 15 wt. % of used motor oil bottoms prepared by the process of the present invention, (b) about 0 to about 20 wt. %, preferably about 0 to about 10 wt. % of a polymer modifier, (c) about 0 to about 7 wt. %, preferably about 0 to about 5 wt. % of a chemical gellant and (d) at least about 80 wt. %, e.g., about 80 wt. % to about 99 wt. %, say, 90 wt. %, of an asphalt component obtained from conventional vacuum distillation, atmospheric distillation, solvent refining, e.g., solvent deasphalting bottoms, or naturally occurring mineral sources, e.g., Trinidad Lake asphalt. All percents herein are by weight of total composition. Asphalt paving compositions of such blend can exhibit a distinct improvement in low temperature properties, in their resistance to thermal cracking and fatigue as defined by the use of the new Superpave Performance Graded (PG) Asphalt Binder Specifications: AASHTO MP1.

In yet another aspect, the present invention relates to a pavement composition comprising aggregate and from about 1-10 wt. % of an asphalt blend containing at least about 80 wt. % of asphalt and from about 0.5-15 wt. % of the bottoms fraction of prepared by the process of the present invention

DETAILED DESCRIPTION OF THE PREFERRED EMBODIMENTS

Process

Figure 1:
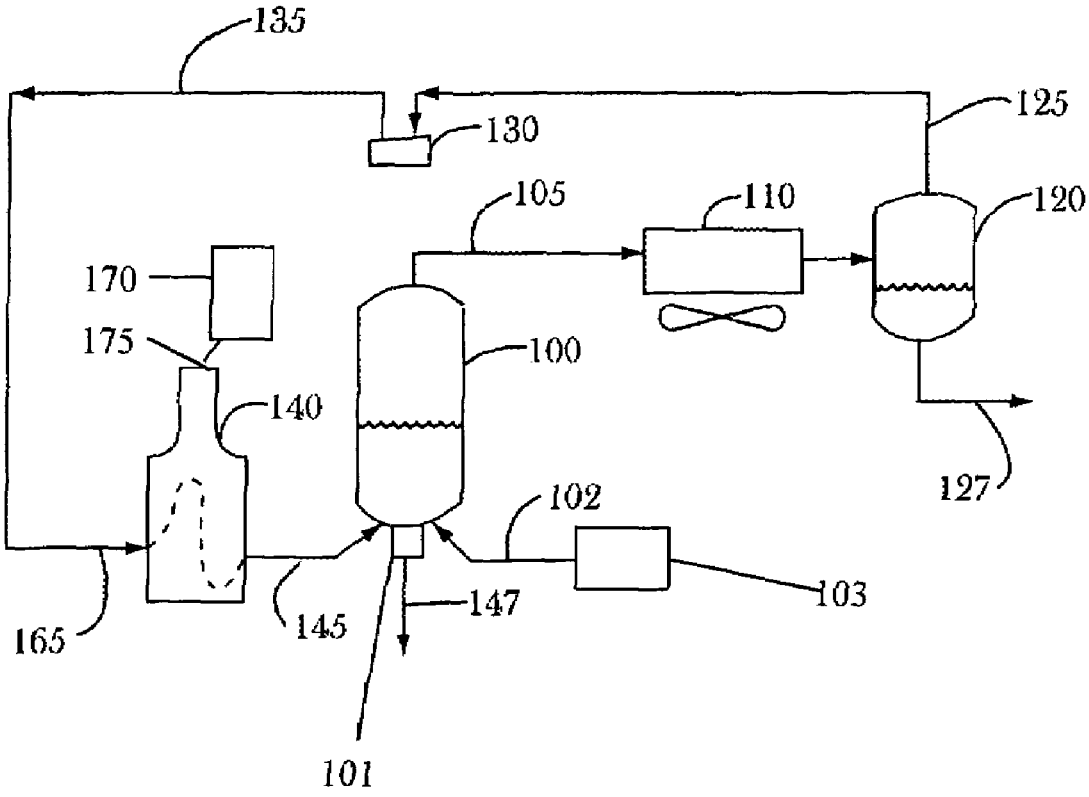
FIG. 1 is a schematic diagram illustrating a preferred embodiment of the process of the present invention.

Further features and advantages of the present invention will become apparent to those skilled in the art from the description of the preferred embodiment herein set forth.

The hydrocarbon materials that can be treated in accordance with the present invention include FCC/RCC slurry oil, asphalt, petroleum pitch and the like, used crankcase oil from motor vehicles such as, for example, cars, trucks and railroad locomotives, as well as automatic transmission fluids and other functional fluids in which the major constituent is an oil of lubricating viscosity. Unavoidably, used lubricating oil often contains amounts of water and other hydrocarbon liquids, e.g., light hydrocarbons having a boiling point of less than 600° F., e.g., less than 210° F. The present invention is especially advantageous inasmuch as no pre-separation of water and light hydrocarbons liquids is necessary.

Included within the group of heavier hydrocarbon materials suitable for treatment herein are used motor oils having mineral lubricating oils such as liquid petroleum oils and solvent-treated or acid-treated mineral lubricating oils of the paraffinic, naphthenic or mixed paraffinic-naphthenic types as the base oil. Oils of lubricating viscosity derived from coal or shale oil can also be included as the base oil of such used motor oils. This group also includes used motor oils having as the base oil synthetic lubricating oils including hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof, alkylbenzenes (e.g., dodecylbenzenes, tetradecylbenzenes, dinonylbenzenes, di(2-ethylhexyl)benzenes, etc.): polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic lubricating oils that can be the base oil of the used lubricating oils treated in the present invention. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diethyl ether of polyethylene glycol having a molecular weight of 500-1000, diethyl ether of polypropylene glycol having an average molecular weight of 1000-1500, etc.) or mono- and polycarboxylic esters thereof, for example, the acetic acid esters, mixed $C_3$-$C_8$ fatty acid esters, or the $C_{13}$ Oxo acid diester of tetraethylene glycol.

Another suitable class of synthetic lubricating oils that can be the base oil of the used lubricating oils treated by the present invention comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyladipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils that the used lubricating oils to be treated can be derived from include $C_5$-$C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another class of synthetic oils that can be the base oil of the used lubricating oils that can be treated (e.g., tetraethyl silicate, tetraisopropyl silicate, tetra-(2-ethylhexyl)silicate, tetra-(4-methyl-2-ethylhexyl)silicate, tetra-(p-tert-butylphenyl)silicate, hexa(4-methyl-2-pentoxy)-disiloxane, poly(methyl)siloxanes, poly(methylphenyl)siloxanes, etc.). Other synthetic oils include liquid esters of phosphorus-containing acids (e.g., tricresyl phosphate, trioctyl phosphate, diethyl ester of decylphosphonic acid, etc.), polymeric tetrahydrofurans and the like.

The term "lubricating oil" when used herein does not limit the utility of the oil to lubricating, but is merely a description of a property thereof, namely, that the oil is of lubricating viscosity.

The foregoing used lubricating oils usually contain one or more of various additives such as, for example, oxidation inhibitors (i.e., barium, calcium and zinc alkyl thiophosphates, di-t-butyl-p-cresol, etc.), anti-wear agents (i.e., organic lead compounds such as lead diorganophosphorodithioates, zinc dialkyldithiophosphates, etc.), dispersants, (i.e., calcium and barium sulfonates and phenoxides, etc.), rust inhibitors (i.e., calcium and sodium sulfonates, etc.), viscosity index improvers, (i.e., polyisobutylenes, polyalkylstyrene, etc.), and detergents (i.e., calcium and barium salts of alkyl and benzene sulfonic acids and ashless type detergents such as alkyl-substituted succinimides, etc.). Additionally, the used lubricating oils treated in accordance with the present invention usually contain various contaminants resulting from incomplete fuel combustion as well as water and gasoline.

The process of the present invention is particularly suitable for removing or reducing to acceptable levels (e.g., to permit subsequent hydrogenation without poisoning the hydrogenation catalyst) the above-indicated nitrogen-containing materials and metal-containing materials.

In certain embodiments, the process of the present invention reduces or eliminates the need for further hydrogenation of the oxidized hydrocarbon materials. FIG. 1 is a simplified process flow diagram from which most pumps, heat exchangers and the likes have been omitted. A vaporizer or vessel 100 is operatively connected to at least one atomizing nozzle 101. The nozzle 101 receives a liquid feed stream of heated heavier hydrocarbon material via 102 from a heating vessel 103. The nozzle also receives a supply of a gaseous mixture, or stream, of superheated steam and at least one reaction gas from line 145. In the vessel 100 the hydrocarbon materials are oxidized and thermally react with the reaction gas such that a heavier liquid product and a lighter overhead, or volatile, product are produced. The overhead volatile product and steam are removed overhead via line 105 and charged to a hot separator vessel 120, which preferably operates at a temperature low enough to condense essentially all of the volatile product and yet be at a temperature above the condensing temperature of steam. The now condensed overhead hydrocarbon product is removed from the vessel 120 via line 127. The superheated steam is removed as a vapor via line 125 to a suitable condenser 130. The condensed steam is then charged via lines 135 and 165 to a heater 140. A supply of reaction gas is supplied from a vessel 170 via a line 175 into the heater 140. The steam is combined with the at least one reaction gas to produce the gaseous mixture. The gaseous mixture of the steam and the at least one reaction gas is supplied via line 145 to the atomizing nozzle 101. At least periodically a liquid, heavier residue fraction is withdrawn from vessel 100 via line 147.

The stream of steam and reaction gas are superheated to a temperature of 700 to 1600° F. The stream is introduced into the nozzle 101 at a rate of 1 to 3 pounds/pound of charge, in order to further heat the heavier hydrocarbon materials to a preferred temperature by direct contact.

In certain embodiments, the hydrocarbon material can be preheated prior to the step of directly contacting the at least one stream of the hydrocarbon materials with the heated stream comprising steam and the at least one reaction gas. Also, hydrocarbon material can be at least partially fractionated or flashed to remove a majority, by weight, of at least one of chemical solvents boiling in the gasoline boiling range and gasoline boiling range components prior to being contacted by the steam and the at least one reaction gas.

The required contact time for the heavier hydrocarbon material is dependent on the composition of the heavier hydrocarbon material. In embodiments where there is a concentration of organo-metallic compounds in the used oil, the desired extent of decomposition of the organo-metallic compounds and the desired volume reduction and degree of lift, the introduction rate of the gaseous mixture is adjusted to avoid entrainment of organo-metallic compounds into the overhead fraction which contains water, light hydrocarbons, and distillatable oil.

The process of the present invention is preferably carried out in a vessel stirred by the action of the impinging velocity of the heated streams of heavier hydrocarbon materials and gaseous mixture of steam and reaction gas being introduced therein. The vessel can be entirely conventional in design and construction. The size, design and construction of such vessel are dependent upon the volume and type of heavier hydrocarbon materials to be processed. In one embodiment, stream of atomized hydrocarbon material and stream of gaseous mixture (i.e. steam and reaction gas) from the nozzle enters at the bottom of the vessel, the volatile overhead product and steam exits at the top of the vessel, and the residue is drained from the bottom of the vessel. No internal components are necessary.

It is to be understood that the overhead fraction can be passed through a vacuum distillation column (not shown) wherein lighter hydrocarbons (suited to use as fuel gas after separation) are taken off as overhead. Also, the distillate product may be recovered as a single product but is typically fractionated to produce a number of distillate fractions which have the boiling range of the final product desired. Different fractions are taken off the column at separate collection points and collected. The collected distillate product may be further treated by catalytic hydrogenation or clay treatment (not shown) to reduce sulfur content, improve color, saturate olefins and thereby increase stability and reduce gum forming compounds. The vacuum bottoms are also taken off and may be used as fuel oil, asphalt extender, feedstock for delayed coking, feedstock for partial oxidation or a gasifier or for cement kiln fuel where the metal would remain in the product cement. The bottoms fraction from the vessels are removed and are directed through a suitable line (not shown) for addition to fuel oil or, alternatively, directed for mixing with asphalt in a suitable asphalt mixing means.

Figure 2:
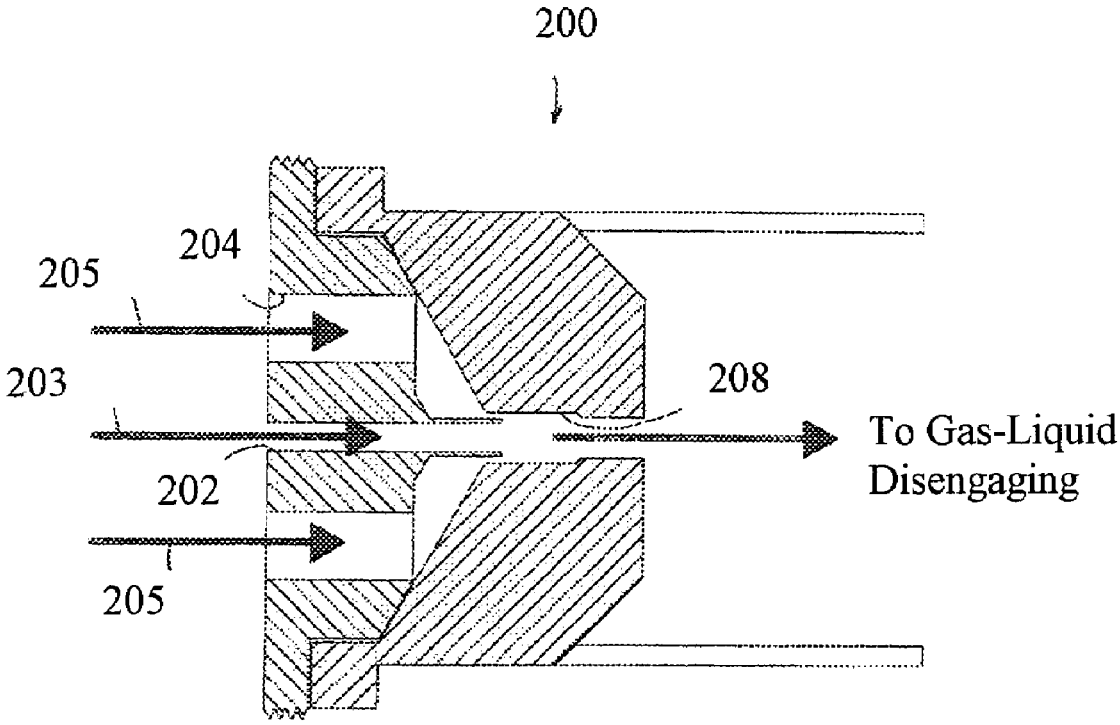
FIG. 2 is a schematic diagram illustrating an atomizing nozzle useful in the process of the present invention.

FIG. 2 is a schematic illustration of an atomizing nozzle 200. The nozzle 200 defines a first opening 202 for receiving a supply 203 of the heavier hydrocarbon material. The nozzle 200 further defines an annular opening 204 which coaxially surrounds the first opening 202. The annular opening 204 receives a supply 205 of the stream of steam and at least one reaction gas. The annular opening 204 of the nozzle 200 has a desired shape such that the stream of steam and reaction gas readily mixes with the supply of heavier hydrocarbon materials being injected into the nozzle 200. The annular opening 204 and the first opening 202 terminate at a mixing channel 208. The velocity of the gaseous mixture stream 205 and the heavier hydrocarbon material 203 causes the heavier hydrocarbon material to be atomized and to react with the reaction gas.

Asphalt Blend Compositions Containing Used Motor Oil Bottoms Asphalt Component

Any suitable asphalt or asphalt cement may be employed for producing the modified asphalt blend compositions of the invention. For example, industrial asphalts used for coatings, sealants, roofing materials, adhesives, and other applications may be used. Paving grade asphalt compositions, however, are employed in the preferred embodiment of the invention. Asphalt compositions may be derived, as indicated, from any well known bituminous or asphaltic substance obtained from natural sources or derived from a number of sources such as petroleum, shale oil, coal tar, and the like, as well as mixtures of two or more of such materials. Typical of such asphalts are the straight run asphalts derived from the atmospheric, steam and/or vacuum distillation of crude oils, or those asphalts derived from solvent precipitation treatments of raw lubricating oils and their fractions. Also included are the thermal or "cracked" asphalts which are separated as cracker bottom residues from refinery cracking operations and the asphalts produced as byproducts in hydrorefining operations. A preferred asphalt is the vacuum tower bottoms that is produced during the refining of synthetic or petroleum crude oils. As indicated, for paving applications, any suitable paving grade asphalt may be employed for the compositions of the invention. Such paving grade asphalt compositions are often referred to as viscosity, penetration graded, or performance graded (PG) asphalts having penetrations up to 400 as measured by ASTM method D5. Preferred asphalts are the performance graded asphalts such as PG 46-40, PG 46-34, PG 46-28, PG 52-40, PG 52-34, PG 52-28, PG 52-22, PG 58-40, PG 58-34, PG 58-28, PG 58-22, PG 64-40, PG 64-34, PG 64-28, PG 64-22, PG 70-40, PG 70-34, PG 70-28, PG 70-22, PG 76-40, PG 76-34, PG 76-28, PG 76-22, PG 82-34, PG 82-28, or PG 82-22. The PG in the title refers to Performance Graded, the first numeric designation refers to the binder's high temperature rutting or deformation resistance temperature range limit, and the last numeric designation refers to the binder's low temperature thermal cracking resistance temperature limit. Complete specification requirements are outlined in specifications under AASHTO MP-1-93 Performance Graded Asphalt Binder Specification. AASHTO is the designation for the American Association of State and Highway Transportation Officials.

The asphalt blend compositions of asphalt component and the used motor oil bottoms of the present invention also exhibit improved low temperature performance properties without excessive sacrifice of high temperature PG grade performance, e.g., rutting resistance.

Polymer Modifiers

The polymers used for the present asphalt blends are well-known to those skilled in the art and comprise: Styrene Butadiene (SB) diblock polymers, Styrene-Butadiene-Styrene (SBS) triblock polymers which may be either linear or radial, styrene-isoprene-styrene (SIS) diblocked polymers, hydrotreated SBS, Styrene Ethylene Butadiene Styrene polymers (SEBS), Styrene Butadiene Rubber (SBR), polyacrylamide, e.g., those described in U.S. Pat. No. 4,393,155 to Garrett, Glycidyl-containing ethylene copolymers in U.S. Pat. No. 5,331,028, or Crumb Rubbers.

Gellants

Similarly, the gellants which can be added to the present asphalt blends are not narrowly critical and can include: chemical gellants such as metallic soaps formed by the neutralization of fatty acids and/or rosin acids; organoclays, e.g., bentonites, kaolin clays, etc.; hydrogenated castor oils; oligomers; siloxanes; or others well-known to those skilled in the art or included in the patent or other literature.

Antioxidants

Though not narrowly critical, preferred antioxidants are an oxidation inhibiting or stabilizing amount of a composition selected from metal hydrocarbyl dithiophosphates, and mixtures thereof, and a composition selected from antioxidant butylated phenols, and mixtures thereof, in a specified ratio to each other, as described more fully hereinafter. Preferably, the components are added to the oxidized blend of asphalt and fluxing component so that the resulting product comprises from about 0.1 wt. % to about 5.0 wt. % of a composition selected from metal hydrocarbyldithiophosphates, and mixtures thereof, and from about 0.1 wt. % to about 5.0 wt. % of a composition selected from antioxidant butylated phenols, and mixtures thereof, in a specified ratio to each other, as described more fully hereinafter. Most preferably, metal hydrocarbyl dithiophosphate component employed is a mixture of such dithiophosphates, and the metal hydrocarbyl dithiophosphate component is supplied in an amount of from about 0.1 wt. % to about 2.0 wt. %. The antioxidant butylated phenol is preferably supplied in a range of from about 0.1 wt. % to about 2.0 wt. %.

Hydrocarbon Solvents

The hydrocarbon solvents can be any which are capable of reducing the viscosity of the asphalt blend composition. Preferred solvents include: mineral spirits, naphthas, kerosenes, and fuel oils.

Emulsifiers

The emulsifiers include anionic or cationic or nonionic emulsifiers. Those particularly preferred are those described in U.S. Pat. No. 4,393,155 to Garrett, the contents of which are incorporated herein by reference. Accordingly, it is believed that the used motor oil bottoms produced by the present invention are particularly useful as additives for asphalts having poor fatigue cracking properties, i.e., the used motor oil bottoms fraction can be subsequently added to asphalt in amounts sufficient to improve fatigue cracking at intermediate temperatures by lowering dynamic shear measurement DSR.sub.PAV passing temperature of the resulting blend. The bottoms fraction can be present in an amount sufficient to improve fatigue cracking and/or thermal cracking characteristics by lowering passing temperatures of dynamic shear rheometer AASHTO-TP5-93 and/or bending beam rheometer AASHTO-TP1-93.

Because the high temperature limit of asphalt binders displays a strong correlation to viscosity, it is believed that improved Performance Grade ratings can be obtained by raising the viscosity of the blend to, say, 1800 or 2000 poise.

By way of further illustration of the process of the present invention, reference may be made to the following example. Unless otherwise indicated, all parts and percentages are by weight.

EXAMPLE 1

Continuous Process

Heavier hydrocarbon material near ambient temperature was heated and then injected on the atomizing nozzle where the heavier hydrocarbon material was mixed rapidly with the superheated steam and reaction gas. The heavier hydrocarbon material reacted with the reaction gas to form the volatile overhead product. The oxidized heavier product separated from the steam-lighter overhead product mixture and flowed to a residue accumulator. The steam-light overhead mixture was cooled first to 225° F., where most of the overhead product condensed. The steam was condensed and collected in a water condensate accumulator. The process avoided indirect heat transfer while ensuring that the highest temperature the heavier hydrocarbon material reached was the atomizer outlet temperature. The atomized heavier hydrocarbon material was cooled quickly so residence time at atomizer temperature was short. Steam stripping allowed a lower flash temperature for a given amount of heavier hydrocarbon material vaporization compared to atmospheric or even moderate subatmospheric flash vaporization. An equal weight of steam to heavier hydrocarbon material charge is equivalent to moderate vacuum flashing because the molecular weight of steam is 10 to 30 times less than that of heavier hydrocarbon material.

MODIFICATIONS

Specific compositions, methods, or embodiments discussed are intended to be only illustrative of the invention disclosed by this specification. Variations on these compositions, methods, or embodiments are readily apparent to a person of skill in the art based upon the teachings of this specification and are, therefore, intended to be included as part of the invention disclosed herein.

Reference to documents made in the specification is intended to result in such patents or literature being expressly incorporated herein by reference, including any patents or other literature references cited within such documents.

We claim:

1. A process for promoting oxidation and thermal reaction of hydrocarbon materials and for removing volatile components therefrom which comprises:

a) directly contacting at least one stream of the hydrocarbon materials with a heated stream of a gaseous mixture comprising steam and at least one reaction gas selected from the group comprising oxygen, air or hydrogen, under temperature, contact times, and superficial velocity conditions sufficient i) to at least partially oxidize the hydrocarbon materials, and ii) to provide a desired volume of at least partially oxidized liquid product in at least one suitable disengaging vessel, and a remaining volume of volatile overhead product and steam;

b) condensing the volatile overhead product in at least one stage;

c) recovering at least part of the volatile overhead product as distillate;

d) condensing the steam in a second stage, and e) recovering a bottoms fraction containing the at least partially oxidized liquid products;

wherein the contacting of the hydrocarbon stream and the gaseous mixture stream is carried out in at least one atomizing nozzle;

wherein the at least one atomizing nozzle further comprises a first opening, an annular opening coaxially surrounding the first opening and a mixing channel wherein the first opening and the annular opening terminate in the mixing channel;

wherein the hydrocarbon stream passes through the first opening into the mixing channel;

wherein the gaseous mixture stream passes through annular opening coaxially surrounding the first opening into the mixing channel; and wherein the gaseous mixture coaxially surrounds the hydrocarbon stream in the mixing channel.

2. The process of claim 1, which is carried out in the absence of process fouling.

3. A process for promoting oxidation and thermal reaction of hydrocarbon materials and for removing volatile components therefrom which comprises:

a) directly contacting at least one stream of the hydrocarbon materials with a heated stream of a gaseous mixture comprising steam and at least one reaction gas selected from the group comprising oxygen, air or hydrogen, under temperature, contact times, and superficial velocity conditions sufficient i) to at least partially oxidize the hydrocarbon materials, and ii) to provide a desired volume of at least partially oxidized liquid product in at least one suitable disengaging vessel, and a remaining volume of volatile overhead product and steam;

b) condensing the volatile overhead product in at least one stage;

c) recovering at least part of the volatile overhead product as distillate;

d) condensing the steam in a second stage, and e) recovering a bottoms fraction containing the at least partially oxidized liquid products;

wherein the contacting of the hydrocarbon stream and the gaseous stream is carried out in at least one atomizing nozzle; and wherein heated stream of steam and at least one reaction gas is vaporized at temperatures ranging from 450 to 1800° F., a vapor rate of 0.1 to 10 pounds heated vapor per pound of charge, and a superficial velocity of about 5.5 feet per second or less, to provide vaporization temperatures ranging from about 400 to about 1000° F., and the hydrocarbon material is contacted with the heated stream of steam and the at least one reaction gas for a period ranging from 0.1 to 2 seconds.

4. The process of claim 3, wherein said vaporization temperatures, vapor rate, superficial velocity, and contact times are adjusted to provide a volume reduction of the total amount of the hydrocarbon materials ranging from 20 to 95 wt. %.

5. A process for promoting oxidation and thermal reaction of hydrocarbon materials and for removing volatile components therefrom which comprises:

a) directly contacting at least one stream of the hydrocarbon materials with a heated stream of a gaseous mixture comprising steam and at least one reaction gas selected from the group comprising oxygen, air or hydrogen, under temperature, contact times, and superficial velocity conditions sufficient i) to at least partially oxidize the hydrocarbon materials, and ii) to provide a desired volume of at least partially oxidized liquid product in at least one suitable disengaging vessel, and a remaining volume of volatile overhead product and steam;

b) condensing the volatile overhead product in at least one stage;

c) recovering at least part of the volatile overhead product as distillate;

d) condensing the steam in a second stage, and e) recovering a bottoms fraction containing the at least partially oxidized liquid products;

wherein the contacting of the hydrocarbon stream and the gaseous mixture stream is carried out in at least one atomizing nozzle; and wherein the heated stream of steam and the at least one reaction gas is introduced in the atomizing nozzle at temperatures ranging from 700 to 1100° F., at a rate of 2 to 3 pounds per pound charge, and a superficial velocity of at least about 3 feet per second to provide vaporization temperatures in the atomizing nozzle ranging from about 550 to about 650° F., and the hydrocarbon material is contacted with the stream of steam the at least one reaction gas for a period ranging from 0.25 to 0.5 seconds.

6. The process of claim 1, wherein heated steam is recovered from the volatile overhead product and recycled to the atomizing nozzle.

7. The process of claim 1, wherein the hydrocarbon materials comprise raw used lubricating oil which light ends having a boiling point of less than about 210° F.

8. The process of claim 1, wherein at least about 20 to 95 vol. % of the hydrocarbon material is oxidized.

9. The process of claim 8, further comprising the steps of vaporizing at least 60 to about 90 wt. % of the hydrocarbon materials condensing the vaporized hydrocarbon material and removing the condensed hydrocarbon material as at least partially oxidized liquid product.

10. The process of claim 1, in the hydrocarbon material processed comprises at least one of FCC/RCC slurry oil, asphalt or petroleum pitch.

11. The process of claim 1 wherein the hydrocarbon material is preheated prior to being directly contacted with the heated gaseous mixture comprising steam and the at least one reaction gas.

12. The process of claim 11, wherein hydrocarbon material is at least partially fractionated or flashed to remove a majority by weight of at least one of chemical solvents boiling in the gasoline boiling range and gasoline boiling range components prior to being contacted by the steam and the at least one reaction gas.

* * * * *